US009149124B1

(12) United States Patent
Savovic

(10) Patent No.: US 9,149,124 B1
(45) Date of Patent: Oct. 6, 2015

(54) ENGINEERED SEATING SYSTEM FOR USE IN MEDICAL LIFT CHAIRS

(71) Applicant: Joseph Savovic, Sherrills Ford, NC (US)

(72) Inventor: Joseph Savovic, Sherrills Ford, NC (US)

( * ) Notice: Subject to any disclaimer, the term of this patent is extended or adjusted under 35 U.S.C. 154(b) by 48 days.

(21) Appl. No.: 14/245,553

(22) Filed: Apr. 4, 2014

Related U.S. Application Data

(60) Provisional application No. 61/808,531, filed on Apr. 4, 2013.

(51) Int. Cl.

| | |
|---|---|
| ***A47C 7/02*** | (2006.01) |
| ***A47C 7/24*** | (2006.01) |
| ***A47C 7/54*** | (2006.01) |
| ***A47C 7/40*** | (2006.01) |
| ***A47C 7/34*** | (2006.01) |
| ***A61G 5/14*** | (2006.01) |

(52) U.S. Cl.
CPC . *A47C 7/24* (2013.01); *A47C 7/347* (2013.01); *A47C 7/40* (2013.01); *A47C 7/54* (2013.01); *A61G 5/14* (2013.01)

(58) Field of Classification Search
CPC ..... A47C 5/00; A47C 27/056; A47C 27/063; A47C 27/064; A47C 27/15; A47C 27/16; A47C 27/20; A47C 7/24; A47C 7/54; A47C 7/40; A47C 7/347
See application file for complete search history.

(56) References Cited

U.S. PATENT DOCUMENTS

| | | | | |
|---|---|---|---|---|
| 2,234,253 | A * | 3/1941 | Hopkes | 267/87 |
| 4,305,616 | A * | 12/1981 | Martinez | 297/440.15 |
| 4,711,495 | A * | 12/1987 | Magder | 297/452.52 |
| 4,753,480 | A * | 6/1988 | Morell | 297/452.27 |
| 4,886,250 | A * | 12/1989 | Lucas | 267/95 |
| 6,116,694 | A * | 9/2000 | Bullard | 297/452.52 |
| 6,230,351 | B1 * | 5/2001 | Kohnle | 5/690 |
| 6,971,717 | B1 * | 12/2005 | Rhodes | 297/230.1 |
| 7,267,408 | B2 * | 9/2007 | Xiang | 297/452.59 |
| 8,512,854 | B2 * | 8/2013 | Fox et al. | 428/316.6 |
| 2011/0173757 | A1 * | 7/2011 | Rensink et al. | 5/698 |
| 2013/0174344 | A1 * | 7/2013 | Klancnik et al. | 5/636 |

* cited by examiner

*Primary Examiner* — Philip Gabler
(74) *Attorney, Agent, or Firm* — Bell Nunnally & Martin LLP; Craig J. Cox

(57) ABSTRACT

Described herein is a chair for relieving pressure points from prolonged sitting. The chair comprises a plurality of armrests, the armrests comprising: an armrest frame; a foam layer coupled to an upper portion of the armrest frame; and a first gel infused foam layer coupled to an upper portion of the foam layer. The chair further comprises a seat bottom, the seat bottom comprising: a seat bottom frame; a sinuous spring base coupled to the seat bottom frame; a plurality of coil springs coupled to the sinuous spring base; and a second gel infused foam layer coupled to the coil springs. The chair further comprises a seat back, the seat back comprising: a seat back frame; elastic webbing coupled to the seat back frame; and one or more cushions coupled to the seat back frame.

20 Claims, 2 Drawing Sheets

ENGINEERED SEATING SYSTEM FOR USE IN MEDICAL LIFT CHAIRS

CROSS REFERENCE TO RELATED INFORMATION

This application claims the benefit of U.S. Provisional Patent Application No. 61/808,531, filed Apr. 4, 2013, the contents of which are hereby incorporated herein in its entirety.

TECHNICAL FIELD

The present disclosure is directed to seating devices, specifically, seating systems for preventing bedsores and other infirmities associated with sitting or lying down for extended periods of time.

BACKGROUND OF THE INVENTION

Bedsores—also called pressure sores or pressure ulcers—are injuries to skin and underlying tissues that result from prolonged pressure on the skin. Bedsores most often develop on skin that covers bony areas of the body, such as the heel, ankles, hips or buttocks. People most at risk of bedsores are those with a medical condition that limits their ability to change positions, requires them to use a wheelchair or confines them to a bed for prolonged periods. Bedsores can develop quickly and are often difficult to treat. Several care strategies can help prevent some bedsores and promote healing.

Anyone sitting in a chair, lying on a bed, or otherwise immobilized for a prolonged period of time can inflame pressure points. Continued inflammation of pressure points caused by being in the same position for extended periods of time can cause sores to appear in affected areas. This is particularly problematic for elderly or disabled persons who for health reasons spend extended periods sitting or lying down. What is needed is a medical lift chair or similar furniture product that prevents pressure points from prolonged sitting.

BRIEF SUMMARY OF THE INVENTION

Described herein is a chair for relieving pressure points from prolonged sitting. The chair comprises a plurality of armrests, the armrests comprising: an armrest frame; a foam layer coupled to an upper portion of the armrest frame; and a first gel infused foam layer coupled to an upper portion of the foam layer. The chair further comprises a seat bottom, the seat bottom comprising: a seat bottom frame; a sinuous spring base coupled to the seat bottom frame; a plurality of coil springs coupled to the sinuous spring base; and a second gel infused foam layer coupled to the coil springs. The chair further comprises a seat back, the seat back comprising: a seat back frame; elastic webbing coupled to the seat back frame; and one or more cushions coupled to the seat back frame.

BRIEF DESCRIPTION OF THE DRAWINGS

For a more complete understanding of the present invention, reference is now made to the following descriptions taken in conjunction with the accompanying drawings, in which.

Figure 1:
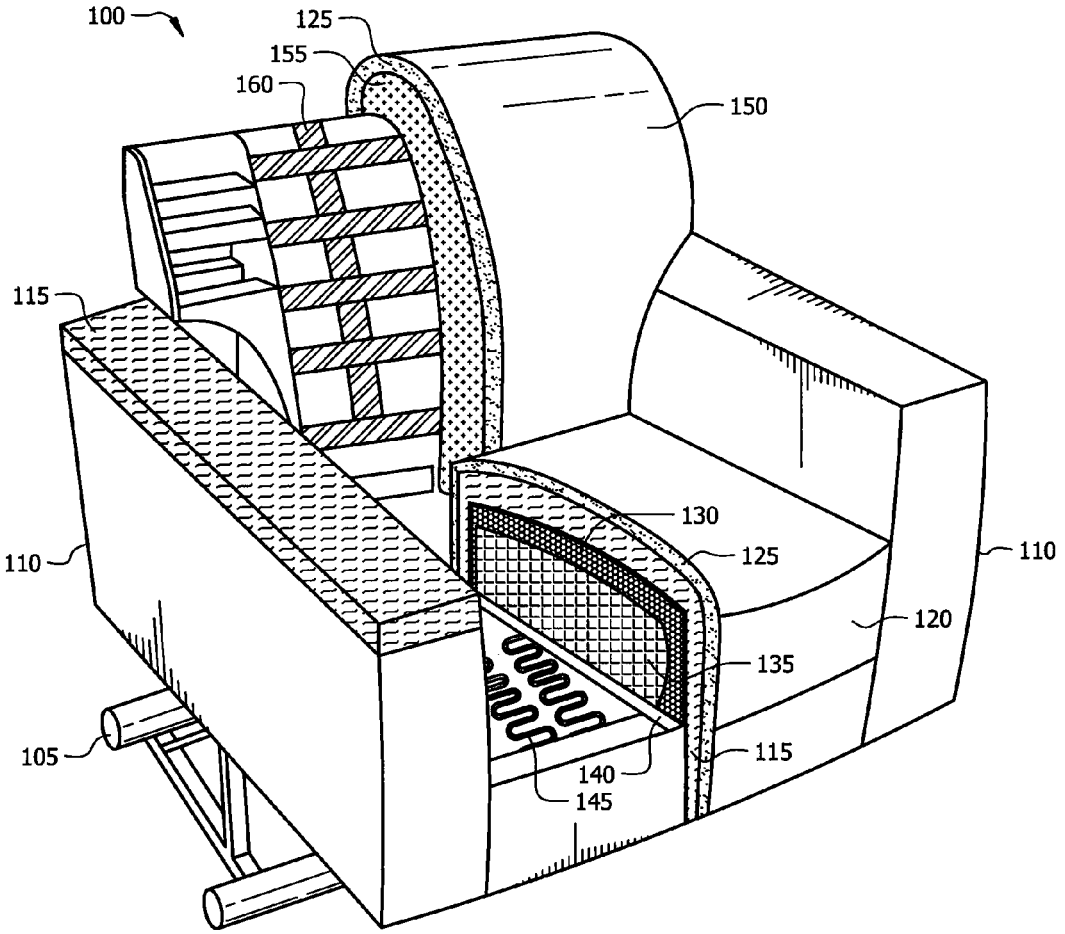
FIG. 1 is a diagram of a preferred embodiment of an engineered seating design for relieving pressure points.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

To eliminate pressure points associated with bedsores, embodiments of an engineered seating design are described herein. The engineered seating design may have applicability to medical lift chairs that also recline and to other types of furniture. The engineered seating design was developed to relieve pressure points commonly incurred by humans sitting in chairs for prolonged periods of time. Gel infused memory foam that is used in mattress products has proven to be beneficial in the relief of pressure points on the human body. The pressure points are nerve bundles that may be aggravated as a result of excess pressure from being in one position for extended periods of time. The engineered seating design, as outlined below, may relieve the pressure points, and provide a therapeutic seating experience not found in other medical lift chairs.

In one embodiment of the engineered seating design, the seat may be based upon commonly used sinuous "no-sag" springs. A wool insulation barrier for noise reduction may be installed above the sinuous springs. Next, a foam encased multi-coil individually wrapped spring unit similar to a "Marshall Spring" unit as used in sleep products such as mattresses may be installed. An additional layer of conventional foam may then be installed depending on allowable seat height and/or model specifications. Gel infused foam meeting CA 117 fire resistance specification may be installed on the additional layer of conventional foam. Finally, a layer Polyethylene terephthalate (sometimes written poly(ethylene terephthalate)), commonly abbreviated PET, PETE, and sold as Dacron, along with a decorative fabric covering may be installed to complete the seating area of the engineered seating design.

The engineered seating design chair arms may have a wood base made from engineered plywood components or hardwoods. A layer of conventional latex foam as used in residential seating may then be installed followed by a layer of gel infused foam to aid in relieving pressure points on arms, elbows and wrists. The chair arms may be wrapped in Dacron and decorative fabric as well.

The engineered seating design back may have a wood base made from engineered plywood components or hardwoods.

Elastic webs, sometimes referred to as Pirelli Webbing, may be installed on the frame. The webs may run horizontally and vertically in order to conform to any body shape and also form part of the overall system that relieves the common pressure points as the result of prolonged seating. A baffle bag may be installed on the elastic webs. The baffle bag may be a cushion filled with shredded foam fill. The seat back may be wrapped in Dacron and decorative fabric as well.

In an alternate embodiment, the engineered seating design back may have a wood base made from engineered plywood components or hardwoods. Elastic webs, sometimes referred to as Pirelli Webbing, may be installed on the frame. The webs may run horizontally and vertically in order to conform to any body shape and also form part of the overall system that relieves the common pressure points as the result of prolonged seating. A baffle bag may be installed on the elastic webs. The baffle bag may be a cushion filled with shredded foam fill. A layer of gel infused foam may be installed on the baffle bag to relieve pressure points on back of a user. The seat back may be wrapped in Dacron and decorative fabric as well.

FIG. 1 is a diagram of a preferred embodiment of an engineered seating design for relieving pressure point 100. The engineered seating design 100 may be coupled to a base 105. The engineered seating design 100 may comprise a lift mechanism (not pictured) between the base 105 and the bottom of a seating area. The lift mechanism may assist a person sitting on the engineered seating design 100 with getting up, or sitting down in the engineered seating design 100. Engineered seating design 100 may be built upon a frame structure (not picture) made up of engineered plywood perimeter in conjunction with solid hardwoods for additional support. The frame structure may be made of other materials suitable for providing a frame for the components of the engineered seating design 100 described herein.

Engineered seating design 100 may comprise two side armrests 110. Each of the side armrests 110 may be topped with gel foam 115. The thickness of gel foam 115 may be selected to relieve pressure points of a person seated in the engineered seating design 100. In a preferred embodiment, the thickness of gel foam 115 may be two inches. Gel foam 115 may be selected from a variety of materials suitable to relieve pressure felt at pressure points of a seated person. Gel foam 115 may conform to the shape of the body resting against it. Gel foam 115 may more evenly distribute a person's weight while providing pressure relief. As an example, gel foam 115 may be Gel Memory Foam. In some embodiments, gel foam 115 may be a flame retardant material compatible with CA Bulletin 117 guidelines. Side armrest 110 may also comprise a layer of conventional latex foam (not pictured). Side armrest 110 may be covered with covering 125 described in greater detail below.

Engineered seating design 100 may further comprise a seat bottom 120. Seat bottom 120 may have an outside covering 125. Covering 125 may be a polyethylene terephthalate (PET, PETE) based fiber (commonly referred to as Dacron) covered with a decorative fabric. Other synthetic fibers or organic fibers may be used for covering 125 based upon the application of engineered seating design 100, desires of a consumer, and/or requirements of certain codes. Beneath covering 125, a layer of gel foam 115 may be used similarly as described above in the side armrest 110. Once again the thickness of gel foam 115 in a preferred embodiment is two inches. Beneath gel foam 115, a non-gel foam layer 130 may be used. Thickness of the non-gel foam layer 130 may be selected based upon the allowable seat height of engineered seating design 100, based upon requirements of the consumer or other guidelines provided by a purchaser or regulatory body. In a preferred embodiment, non-gel foam layer 130 may be a 1.8-2.0 density foam used as an encasement for springs 135. Springs 135 may be individually wrapped coil springs similar to a "Marshall Spring" found in sleep products. In other embodiments, springs 135 may not be individually wrapped and may be selected from other types of foundations typical in seating and/or sleeping areas, i.e. foam bases. Springs 135 may be selected to provide a balanced seating support for the gel foam 115 and to provide increased longevity over other types of base materials, i.e. foam bases. Springs 135 may rest on an insulation layer 140. Insulation layer 140 may be cotton, wool, or any other suitable material for insulating the sound from a motor (not pictured) that may assist in lifting the engineered seating design 100 as described above to assist with a person getting up or sitting down. Insulation layer 140 may rest on support springs 145. Support springs 145 may be sinuous springs or some other shaper spring selected to prevent sagging of the seat bottom 120.

Engineered seating design 100 may further comprise a seat back 150. Seat back 150 may be covered with covering 125. Seat back 150 may be baffled cushions filled with a filling 155. Filling 155 may be shredded foam or some other material selected for comfort of users of engineered seating design 100. Filling 155 may be supported by webbing 160. Webbing 160 may be Pirelli webbing or some other elastic webbing selected to conform to a user's back. Webbing 160 may be configured in a crisscross pattern of horizontal and vertical webbing elements. Other patterns may be selected for webbing 160 as required for support of users.

Figure 2:
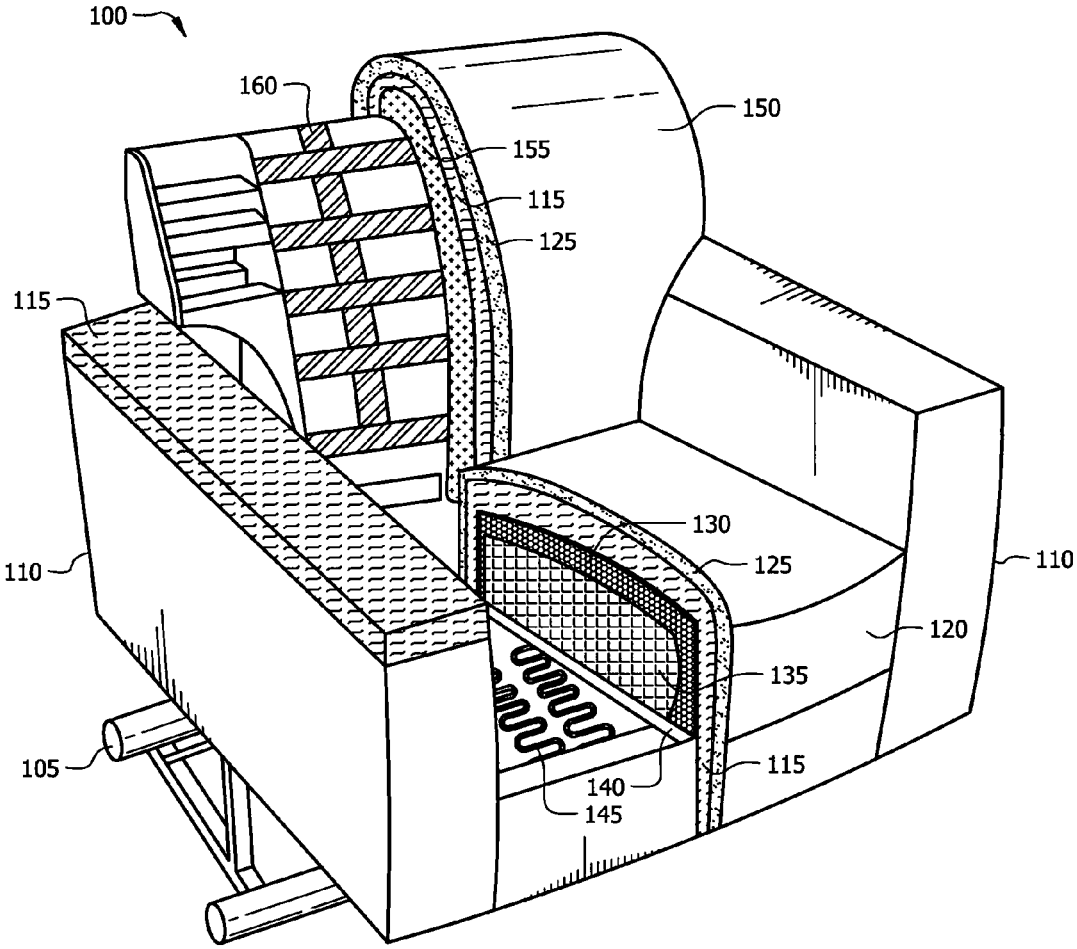
FIG. 2 is a diagram of an alternate embodiment of an engineered seating design for relieving pressure points.

FIG. 2 is a diagram of an alternate embodiment of an engineered seating design for relieving pressure point 100. In this alternate embodiment, seat back 150 comprises a layer of gel foam 115 beneath covering 125. The additional gel foam 115 in seat back 150 may further relieve pressure points in a user's back.

Engineered seating design 100 may be used in a medical lift char as described above and in the figures. Engineered seating design 100 may also be used in other types of furniture where users may be seated for extended periods of time. For example, all or a portion of a couch or loveseat may be constructed using engineered seating design 100. While certain materials are described herein for use in engineered seating design 100, other materials suitable for use in engineered seating design 100 may be used as required by manufacturers, users, consumers, and/or regulatory bodies.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A chair for relieving pressure points from prolonged sitting comprising:

a plurality of armrests comprising:
an armrest frame;
a foam layer coupled to an upper portion of the armrest frame; and
a first gel infused foam layer coupled to an upper portion of the foam layer;
a seat bottom comprising:
a seat bottom frame;
a sinuous spring base coupled to the seat bottom frame;
a plurality of coil springs coupled to the sinuous spring base; and
a second gel infused foam layer coupled to the coil springs; and
a seat back comprising:
a seat back frame;
elastic webbing coupled to the seat back frame; and
one or more cushions coupled to the seat back frame.

2. The chair of claim 1, wherein the plurality of armrests further comprise a covering, the cover comprising a synthetic fiber layer and a decorative fabric layer, and wherein the seat bottom further comprises the covering, and wherein the seat back further comprises the covering.

3. The chair of claim 2, wherein the synthetic fiber is polyethylene terephthalate.

4. The chair of claim 1, wherein the seat bottom further comprises a foam spring encasement, the foam spring encasement encasing the coil springs.

5. The chair of claim 4, wherein the foam spring encasement is 1.8-2.0 density foam.

6. The chair of claim 1, wherein the seat bottom further comprises an insulation layer.

7. The chair of claim 6, further comprising a base coupled to a motor for lifting the chair.

8. The chair of claim 1, wherein the elastic webbing is pirellli webbing.

9. The chair of claim 1, wherein the cushions are baffled cushions.

10. The chair of claim 1, wherein the cushions are filled with shredded foam.

11. A chair for relieving pressure points from prolonged sitting comprising:
a plurality of armrests comprising:
an armrest frame;
a foam layer coupled to an upper portion of the armrest frame; and
a first gel infused foam layer coupled to an upper portion of the foam layer;
a seat bottom comprising:
a seat bottom frame;
a sinuous spring base coupled to the seat bottom frame;
a plurality of coil springs coupled to the sinuous spring base; and
a second gel infused foam layer coupled to the coil springs; and
a seat back comprising:
a seat back frame;
elastic webbing coupled to the seat back frame;
one or more cushions coupled to the seat back frame; and
a third gel infused foam layer coupled to the coil springs.

12. The chair of claim 11, wherein the plurality of armrests further comprise a covering, the cover comprising a synthetic fiber layer and a decorative fabric layer, and wherein the seat bottom further comprises the covering, and wherein the seat back further comprises the covering.

13. The chair of claim 12, wherein the synthetic fiber is polyethylene terephthalate.

14. The chair of claim 11, wherein the seat bottom further comprises a foam spring encasement, the foam spring encasement encasing the coil springs.

15. The chair of claim 14, wherein the foam spring encasement is 1.8-2.0 density foam.

16. The chair of claim 11, wherein the seat bottom further comprises an insulation layer.

17. The chair of claim 16, further comprising a base coupled to a motor for lifting the chair.

18. The chair of claim 11, wherein the elastic webbing is pirellli webbing.

19. The chair of claim 11, wherein the cushions are baffled cushions.

20. The chair of claim 11, wherein the cushions are filled with shredded foam.

* * * * *